United States Patent [19]

Rainer

[11] Patent Number: 5,060,663

[45] Date of Patent: Oct. 29, 1991

[54] PROCESS FOR MINIMIZING LOOSE ENDS IN CIGARETTES

[75] Inventor: Norman B. Rainer, Richmond, Va.

[73] Assignee: Philip Morris Incorporated, New York, N.Y.

[21] Appl. No.: 129,537

[22] Filed: Dec. 7, 1987

Related U.S. Application Data

[63] Continuation of Ser. No. 746,650, Jun. 20, 1985, Pat. No. 4,715,388.

[51] Int. Cl.[5] ..... A24B 15/28; A24C 5/00; A24C 5/18; A24C 5/60

[52] U.S. Cl. ..... 131/77; 131/78; 131/79; 131/84.1

[58] Field of Search ..... 131/78, 79, 77, 84.1

[56] References Cited

U.S. PATENT DOCUMENTS

| | | |
|---|---|---|
| 236,510 | 7/1880 | Pacholder . |
| 1,976,556 | 11/1934 | John . |
| 2,063,014 | 8/1936 | Allen . |
| 2,114,281 | 2/1938 | Allen . |
| 3,008,472 | 4/1961 | Touey . |
| 3,136,321 | 10/1961 | Davis . |
| 3,386,450 | 8/1966 | Seligman . |
| 3,472,237 | 9/1969 | Stephens . |
| 4,009,723 | 2/1977 | Stungis et al. . |
| 4,193,412 | 3/1980 | Heim et al. . |
| 4,409,995 | 10/1983 | Nichols . |

FOREIGN PATENT DOCUMENTS

| | | |
|---|---|---|
| 0067601 | 4/1981 | European Pat. Off. . |
| 0232166 | 8/1987 | European Pat. Off. . |
| 1435711 | 8/1976 | United Kingdom . |
| 2128873 | 5/1987 | United Kingdom . |

*Primary Examiner*—V. Millin

*Attorney, Agent, or Firm*—Mitchell P. Brook; Donald E. Degling

[57] ABSTRACT

A method for producing a tobacco-containing rod from tobacco materials is disclosed. The method comprises shredding tobacco material, mixing a binder with the shredded tobacco material, activating the binder and forming a tobacco-containing rod. The binder may be hydroscopic and the tobacco material may include expanded tobacco.

18 Claims, No Drawings

PROCESS FOR MINIMIZING LOOSE ENDS IN CIGARETTES

This is a continuation of application Ser. No. 746,650, filed June 20, 1985, now U.S. Pat. No. 4,715,388, entitled CIGARETTES HAVING MINIMIZED LOOSE ENDS AND A PROCESS FOR PREPARING SAME.

BACKGROUND OF THE INVENTION

This invention relates to improvements in cigarettes and more particularly concerns a process for producing cigarettes having an increased capacity to retain tobacco material within the cigarette at the forward "smoking" end and a consequent reduction in "loose ends" exhibited by conventional cigarettes.

Conventionally in the production of cigarette smoking products, a loose mixture of generally elongated tobacco shreds of various lengths is mechanically converged upon entrance into a garniture apparatus which compresses the mixture to a rod-like configuration in preparation for wrapping by a retaining cigarette paper of specialized properties. The mass of shreds within the rod is thereby slightly compacted and retains its integrity in part due to entanglement and random orientation of the shreds.

A filter is generally affixed to one end of the wrapped cigarette structure. Due to this construction, the tobacco material is confined between the retaining paper and the filter except at the forward or smoking extremity of the cigarette. Commonly in the course of handling, i.e., when the cigarettes are placed in sealed packages and shipped from the factory to the distributor and ultimately delivered to the consumer, shreds of tobacco dislodge from the forward extremity of the cigarette. Although most of such dislodged tobacco will be retained within the cigarette package, on occasion further tobacco may fall from the forward end of the cigarette during handling by the smoker prior to lighting. The dislodged tobacco creates both a cleanliness problem, and a loss of valuable smoking material. The ends of those cigarettes which have lost tobacco are generally referred to as "loose ends". Upon lighting, such ends burn uncomfortably quickly, and occasionally cause partially burned pieces of tobacco to fall from the cigarette.

The loose end problem is particularly acute in the case of cigarettes fabricated from a tobacco blend containing expanded lamina tobacco. The expanded tobacco, such as that produced by the process of U.S. Pat. No. 4,336,814, is generally utilized in amounts ranging from about 10% to 30% of the blend for the purpose of increasing cigarette firmness at a given weight of filler in the cigarette, and reducing the delivery level of smoke components. Because such cigarettes contain fewer total shreds, and because the expanded tobacco shreds generally have a relatively low length to width ratio, the forces holding the shreds together are lessened. Any approach toward minimizing loose ends which involves addition of aqueous substances would cause irreversible collapse of the expanded tobacco.

Among early efforts to overcome the loose ends problem were proposals to fabricate cigarettes as integral porous structures having no shred-like components capable of falling from the cigarette wrapper. Such methods, however, require a radical departure from present cigarette manufacturing methods, and further represent a significant change from those cigarette products with which present smokers are familiar.

Other approaches directed to overcoming the occurrence of loose ends have involved efforts to interadhere the tobacco shreds so that they will not fall out of the open forward extremity of the cigarette. Such approaches are difficult to achieve in a successful manner because any significant interadherence of shreds prior to entrance into the cigarette making machine impairs the efficiency of cigarette production. Techniques have also been disclosed which involve adding ingredients to the mixture of shredded smoking material at the instant of its entrance into the garniture of a cigarette making machine. Such techniques, however, are difficult to control at the very high speeds of cigarette formation, especially where uniform treatment of the tobacco is desired.

As one example of an approach to resolving the "loose ends" problem, U.S. Pat. No. 3,136,321 concerns a method for utilizing powdered scrap tobacco which ordinarily would not be retainable by a cigarette as an adhesive agent. The method involves the adherence of the powdered scrap material to water-moistened tobacco leaf or shreds. The moistened tobacco, having 17% to 35% water, has a gumminess adequate to facilitate immediate adherence of powdered scrap. The disadvantages of this method are uneven distribution of adhered scrap additive, staining of the cigarette wrapper by the adhesive agents, and the high moisture level of the tobacco which is incompatible with the use of expanded tobacco.

U.S. Pat. No. 4,009,723 discloses an improved method for cutting tobacco products into cigarettes which involves the use of a laser. According to this teaching, the tobacco filler can be pretreated with a bonding material which caramelizes (i.e., melts and rehardens, or changes chemically) to seal ends when a cigarette is cut with a laser, thereby minimizing loose ends. Sugars and sugar containing materials are suggested for use as the bonding material.

Sugar, carbohydrate additives and other adsorbants have been employed in cigarette making for a variety of purposes including fixing additives onto a cigarette or within the tobacco, but have not been employed in an attempt to overcome the problem of "loose ends". In U.S. Pat. No. 1,972,718 tobacco is treated with a finely divided hydrated aluminum silicate or clay which assertedly permits uniform distribution of heat, increases the water content of tobacco and absorbs liberated gases and tars, thereby improving smoke quality. This silicate powder is also employed to add flavorings to the tobacco. Hygroscopic (moisture-absorbing) compounds have frequently been employed to adhere flavorants or other additives to tobacco, or to absorb toxic substances present in the smoke. See, e.g., U.S. Pat. Nos. 2,114,281; 2,063,014; 4,409,995; 3,008,472; 3,472,237; 4,193,412.

U.S. Pat. No. 1,967,556 discloses applying a hygroscopic flavoring material such as glycerine, honey, or maple sugar to the ends of a cigarette containing tobacco originally devoid of such material. The object of the method is to trap tobacco particles and tars which normally are inhaled by passage through the "mouth" end of the cigarette, but avoid irritating fumes caused by the burning of such sugars.

In U.S. Pat. No. 3,386,450 a method for preventing dust loss from reconstituted tobacco compositions made from tobacco dust employs tobacco pectins dissolved in a solution of sugar and water. The solution is sprayed onto the surface of reconstituted tobacco sheet to retain the dust thereon.

There remains therefore a need in the art for a process for minimizing the occurrence of loose ends in cigarettes, including the uniform treatment of shredded tobacco adaptable to current cigarette fabricating processes and equipment. Additionally there is a need for a process adaptable for the same purpose and usable with blends of shredded tobacco containing expanded tobacco.

DEFINITIONS

Oven Volatiles (OV): As used herein, percent moisture may be considered equivalent to oven volatiles (OV), because not more than about 0.9% of tobacco weight is volatiles other than water. Oven volatiles determination is a simple measurement of weight loss of a tobacco sample on exposure in a circulating air oven for 3 hours at 100° C.

Mesh Size: The particle sizes of the particulate adhesive powders used in the practice of this invention may be indicated by mesh size designations of the United States Standard Sieve Series. For example, a notation such as 80/200 means that the powder passes through an 80 mesh sieve (having an opening of 227 microns) and is retained on a 200 mesh sieve (having an opening of 103 microns). In other exemplary sieve sizes, a 100 mesh screen will pass particles of up to 192 microns size, and a 325 mesh sieve will pass particles as large as 66 microns.

Resistance to Draw (RTD) is defined as the pressure developed by the full length of a cigarette when air is pulled through it at the rate of 17.5 ml/second (20° C., 760 torr.); this value is expressed as inches of water.

SUMMARY OF THE INVENTION

The present invention answers the needs in the art by the use of a hygroscopic adhesive composition. According to the present method, tobacco materials are uniformly treated with 1% to 6% of a particulate non-deliquescent hygroscopic adhesive powder, and aged without compaction for a time sufficient for the particulate adhesive to completely adhere to said tobacco. The resulting treated tobacco is supplied to a cigarette making machine. The use of the method results in cigarettes having interadhered shreds showing a considerably decreased tendency to fall out of the cigarette wrapping paper during normal handling.

The method of the present invention may be advantageously employed with any tobacco or tobacco blend at various moisture contents and in various forms. Presently, it is most desirable with shredded tobacco formed of between 10–40% expanded tobacco and having a moisture content of 12–16%.

Substances which may be utilized as the hygroscopic adhesive composition of this invention may be of organic or inorganic origin and may also include components extractively removed from tobacco. Useful adhesive substances are selected from compositions known to be acceptable for use in smoking compositions, such as tobacco pectins, sugars and the like. An adhesive composition of the present invention has the following characteristics: it is a solid in dry form capable of being ground and sieved to produce a fine, free-flowing powder, and has a particulate size preferably in the range of about 50 to 200 microns. Adhesive particles below about 50 microns are not highly effective in producing interbonding of adjacent tobacco shreds. Particles larger than about 200 microns begin to exhibit a tendency to bridge the space between a shred and the wrapper paper with sufficient plastic flow to stain the paper. The adhesive also is characterized by the propensity to absorb moisture with consequent transformation from a free-flowing powder into a tacky substance having plastic type flow characteristics. The adhesive is further characterized as being non-deliquescent, namely, it will not absorb so much water that it transforms into a liquid solution.

A particularly preferred adhesive substance for use in the practice of the present invention is a novel composition derived by the interaction of calcium hydroxide with an aqueous solution of a reducing sugar, such as fructose. Such composition can be produced having a calcium content between about 5% and 12%. Another desirable adhesive substance for use in the present invention is magnesium phosphate.

The adhesive powder is preferably applied to the tobacco blend by entrainment within an air stream which impinges upon and agitates the blend. In such manner, the powder may be accurately metered into the air stream and maintained dry until it contacts the tobacco. The air stream may be adapted to fluidize a bed or a flowing stream of the tobacco, and may be utilized in conjunction with air fluidizing means generally used in association with the feed hopper of a cigarette-making machine.

The duration of the aging step may range from several minutes to about an hour, during which period, the blend is preferably maintained in a state of agitated motion. By the end of the aging step, the blend should not contain particulate adhesive unattached to tobacco because any mobile adhesive capable of contacting the cigarette wrapper could cause staining thereof.

To minimize possible staining of the cigarette wrap paper, the powder must be of a non-deliquescent nature and the powder size must be within prescribed limits. Precautions should be taken to prevent agglomerative formation of large particles during application to the tobacco. All the powder should be permitted to adhere to the tobacco before the cigarette-making operation.

The tobacco thus treated exhibits a tendency toward interadherence of the shreds at their points of contact, particularly when said shreds are brought into compressive assembly under the conditions encountered in the garniture of a cigarette making machine. Such interadherence of the tobacco shreds minimizes the advent of loose ends without occluding the spaces between the shreds, which would adversely affect the resistance to draw (RTD) of the cigarette.

Other aspects and advantages of the present invention will be readily apparent upon consideration of the following detailed description of the preferred embodiments thereof.

DETAILED DESCRIPTION OF THE INVENTION

The following examples are illustrative of presently preferred embodiments of the present invention. The process conditions and specific apparatus employed therein are common in the art; therefore various modifications can be derived from the foregoing disclosure within the scope of the invention. A desirable adhesive substance for use in the present invention is typically prepared by the method of the following example.

EXAMPLE 1

One hundred grams of dry fructose powder were dry-blended with 13 grams of calcium hydroxide powder by shaking in a one liter screw-cap jar. The contents of the jar were added to a one liter beaker containing 400 cc of distilled water. The contents of the beaker were heated to 90° C. with stirring on a hot plate for 2.5 hours, whereupon the mixture developed a dark brown color. The mixture was then filtered on a folded Whatman No. 54 filter paper. The filtered solution, having a pH of 8.0, was poured with continuous agitation into a two liter flask containing one liter of acetone. Two liquid phases are formed thereby. The upper phase was decanted and discarded. The lower phase, a viscous, dark liquid, was poured into a shallow pan and dried first at 100° C. in a forced air furnace, then dried in a vacuum oven at 50° C. The resultant dry material is a hard, brittle glassy solid.

In the course of the $Ca(OH)_2$/fructose reaction, volatile organic aldehydes useful as flavorants or odorants can be combined with the $Ca(OH)_2$/fructose reaction product in a manner such that the organic aldehydes are durably retained until released by the burning coal of the cigarette.

The brittle dry material was transferred to a glove box working area blanketed by dry nitrogen gas and was ground using mortar and pestle. The resultant powder was sieved so as to pass through a 100 mesh screen and be retained on a 325 mesh screen. The resultant powder, when spread as a thin layer on a glass plate and exposed to ambient air at 75° F. and 70% relative humidity, became a tacky layer within ten minutes. When blended at a 3% add-on level onto cut filler tobacco having a 16% OV, the tobacco shreds became sufficiently tacky to interadhere within about five minutes following blending.

In general, the rate at which the calcium/fructose reaction product absorbs moisture is a function of its particle size and calcium content. The smaller particle size material, having relatively greater surface area, absorbs moisture more quickly than larger size particles. Increased calcium levels of the reaction product, achieved by utilizing a higher ratio of calcium hydroxide to fructose, produce products of lessened hygroscopicity, namely, reduced rate of moisture regain. The calcium/fructose reaction product is particularly suitable for use in the process of this invention because its rate of hydration with attendant development of tackiness can be tailored to the needs of a particular cigarette making operation by adjustment of the calcium content. In contrast, when sucrose, a nonreducing sugar, was substituted for fructose in the above example, there was no chemical interaction.

Another desirable adhesive substance for use in the present invention is described below.

EXAMPLE 2

Among inorganic materials suitable for use as adhesive substances in the practice of this invention is magnesium acid phosphate. The magnesium acid phosphate may be prepared by the gradual addition of magnesium carbonate to an aqueous solution of phosphoric acid or polyphosphoric acid until the pH reaches about 3.3. Upon drying, a product is obtained capable of existing as a powder which hygroscopically transforms into a tacky solid.

The production of adhesive material from tobacco products is illustrated in the following example.

EXAMPLE 3

A mixture of approximately equal parts of burley and bright stem material was subjected to a pulping operation to produce an aqueous extract. The extract was subsequently treated to remove nitrate and other inorganic ions, and the resultant solution was evaporated to produce a concentrate solution containing about 35% solids. 300 cc of said concentrated solution was slowly poured into one liter of dry acetone in a beaker provided with good agitation. Two liquid layers formed. The upper, acetone rich layer was decanted. Upon drying, 34.4 grams of a fluid heterogenous tar were isolated. This may be considered the lipophilic component of the content of the extract solution. Even with thorough drying, this remained a tarry substance, and was discarded. The bottom, aqueous layer was washed with two portions of fresh acetone, and was dried in a vacuum oven operating at 60° C. and pressure of about one millimeter of mercury. The resultant dry product, considered to be the hydrophilic component of the initial extract solution, was found to be a rigid form. This was dried further by exposure to $P_2O_5$ in a sealed chamber, and placed in a glove box under dry nitrogen where it was ground using a mortar and pestle, and sieved to a 100/325 mesh size.

The powder thus prepared from the hydrophilic component, when placed on a glass plate as a thin layer and exposed to ambient air at 75° F. and 70% relative humidity, was found to be transformed into a tacky layer within three minutes time.

Another hygroscopic adhesive composition useful in the present method is described below.

EXAMPLE 4

To 386 grams of the concentrated deionized aqueous tobacco extract utilized in Example 3, there was added 10 grams of calcium hydroxide powder. The resultant mixture was heated at 50° C. with stirring for one hour. The thus modified tobacco extract solution was subsequently treated in the same sequence of steps as in Example 3, producing a hydrophilic component powder exhibiting a less rapid rate of moisture regain under ambient air exposure.

The following example illustrates practice of the method of the present invention, employing as the hygroscopic adhesive powder, the products of Examples 1, 2 and 3.

EXAMPLE 5

Fifty gram samples of blended tobacco filler of the type used to make a commercial brand of cigarettes and having a 12.5% oven volatile (OV) content and 10% expanded tobacco content were placed in plastic bags with 1.5 grams of the following adhesive powders, each having a mesh size of 80/150:

a) tobacco extract made by the method of Example 3,
b) $Ca(OH)_2$/fructose reaction product made by the method of Example 1, and
c) magnesium acid phosphate made as described in Example 2.

Each of these powders, when exposed to ambient air for 10 minutes in a thin layer, develops a tarry but nonflowing consistency.

The bags were shaken to uniformly distribute the powders onto the tobacco, representing a 3% add-on in each case. There was no evidence of excess powder unattached to the tobacco, the powders appearing to have much greater affinity for the tobacco than the walls of the plastic bag. The powders also demonstrated the ability to distribute uniformly throughout the tobacco before losing mobility and strongly attaching to the tobacco.

Hand-made cigarettes were then fabricated using a RYO Filtermatic Cigarette Maker made by the Sutliff Tobacco Company of Richmond, Va. The cigarettes were made having a filter on one end, each cigarette containing 0.8 gm filler.

Sixteen of each cigarette sample, including a control having no adhesive additive, were weighed and placed upon a #10 mesh sieve screen of 8 inch diameter. The screen was locked into a Fritsch sieve shaker and vibrated continuously at a setting of #7 for 5 minutes. The cigarettes were reweighed and the percentage of weight loss recorded. The loss of weight was due to the loss of tobacco shreds from the end of the cigarette.

| Percent Weight Loss | |
|---|---|
| Control | 4.1 |
| Tobacco products adhesive | 1.2 |
| Calcium/fructose adhesive | 2.9 |
| Magnesium acid phosphate adhesive | 1.1. |

No staining of the cigarette wrapper was evident on any of the samples. Upon smoking, no subjective difference was detectable between the control and the experimental samples.

The following example demonstrates the advantages of the method of the invention.

EXAMPLE 6

A thirty pound batch of blended tobacco filler of the type used to make a commercial brand of cigarettes (Cambridge filler), containing about 25% expanded tobacco, and having an OV of 13.45%, was divided into three 10 lbs. portions, one of said portions intended to be used as a control, and the other two portions intended for use as experimental samples.

The control sample (sample a) was placed in a baffled horizontal drum of 3 feet diameter and 3 feet depth and rotated at a rate of about 200 rpm for 5 minutes. The tobacco was then removed from the drum and taken immediately to a Mark 8 cigarette making machine. Cigarettes were made having the following characteristics:

| | |
|---|---|
| Cigarette Circumference | 24.8 mm |
| Rod Length | 63.0 mm |
| Rod RTD (avg) | 2.0 inches $H_2O$ |
| Filter Length | 20 mm |

In similar manner, experimental sample (b) was blended in the drum with 119 grams (2.6% by weight of the tobacco) of an 80/140 mesh powder made by the process of Example 3 and having 33% ash, and 2% calcium. Cigarettes of the same construction as the control were fabricated within about 15 minutes of removal of the tobacco from the drum.

Sample (c) was also prepared using 91 grams (2% by weight of the tobacco) of calcium/fructose powder of Example 1 of 80/300 mesh size and having a calcium content of 6.7%.

All cigarettes were weight-selected to 0.835±0.005 gram. Firmness was measured by placing 15 cigarettes in 3 levels of 6, 5, and 4 in a holder having a fixed area trapezoidal shaped shoe. The filled cigarette holder was placed under a compression plate to make contact with the center 40 mm section of the four cigarette rods directly in contact with the plate. The cigarettes were initially compressed with 100 g plate weight until they stabilized in place. At this time, an additional weight of 400 g was automatically dropped by an electromagnet. At the end of 30 seconds, the compression value is automatically recorded which is indicative of cigarette firmness. Loose ends were measured by tumbling 50 cigarettes oriented horizontally, for three minutes. The loose tobacco was collected and weighed. This test was conducted using a Loose Ends Tester, made by the Borgwalt Company of Hamburg, West Germany. The results are reported in Table I below.

TABLE I

| Sample | | RTD (of tobacco rod) | Firmness (mm deflection × 10) | Loose Ends (weight loss g/50 cigarettes) |
|---|---|---|---|---|
| Control | (a) | 2.0 | 36.5 ± 0.4 | 1.97 g |
| | (b) | 2.3 | 37.3 ± 1.1 | .80 |
| | (c) | 2.2 | 36.8 ± 0.4 | 1.38 |

The treatment of the tobacco with hygroscopic powders according to the method of the invention results in cigarettes having significantly reduced loose ends. The cigarettes are substantially unaffected with respect to firmness, RTD, and smoking quality.

Numerous modifications and variations in the practice of the invention are expected to occur to those skilled in the art upon consideration of the foregoing descriptions of preferred embodiments thereof. Consequently, only such limitations as appear in the appended claims should be placed upon the scope of the invention.

I claim:

1. A method for producing a tobacco-containing rod from tobacco materials comprising the steps of shredding tobacco material, mixing a binder with the shredded tobacco material, subjecting the mixture of binder and shredded tobacco material to conditions which cause the binder to become tacky and forming a tobacco-containing rod from the mixture of shredded tobacco material and binder.

2. A method for producing a tobacco-containing rod from tobacco materials comprising the steps of shredding tobacco material, mixing a binder with the shredded tobacco material, forming a tobacco-containing rod from the mixture of shredded tobacco material and binder and subjecting the tobacco-containing rod to conditions which cause the binder to become tacky.

3. A method as described in claim 1 or claim 2 in which the binder is an hygroscopic adhesive powder.

4. A method as described in claim 3 in which the binder is selected from the group consisting of an aqueous extract of tobacco, a magnesium acid phosphate, a reaction product of $Ca(OH)_2$ with a reducing sugar containing between about 5% and about 12% of calcium, pectin, sucrose, glucose and fructose.

5. A method as described in claim 3 wherein said hygroscopic adhesive powder has a particle size of between about 50 and about 200 microns.

6. A method as described in claim 5 wherein said hygroscopic adhesive powder becomes tacky upon absorption of moisture.

7. A method as described in claim 3 in which the tobacco materials include expanded tobacco.

8. A method as described in claim 7 in which the binder is selected from the group consisting of an aqueous extract of tobacco, a magnesium acid phosphate, a reaction product of a $CO(OH)_2$ with a reducing sugar containing between about 5% and about 12% of calcium, pectin, sucrose, glucose and fructose.

9. A method as described in claim 7 wherein said tobacco materials comprise a blend of shredded tobacco having between about 12% to about 16% OV and comprising about 10% to about 40% expanded tobacco.

10. A method for producing a tobacco-containing rod from tobacco materials comprising the steps of providing shredded material, providing a binding agent, contacting the shredded tobacco material and the binding agent, forming an intimate admixture of the shredded tobacco material and the binding agent, subjecting the binding agent to conditions which cause the binding agent to become tacky, and forming a tobacco-containing rod from the admixture of shredded tobacco material and binding agent.

11. A method for producing a tobacco-containing rod from tobacco materials comprising the steps of providing shredded tobacco material, providing a binding agent, contacting the shredded tobacco material and the binding agent, forming an intimate admixture of the shredded tobacco material and the binding agent, forming a tobacco-containing rod from the admixture of shredded tobacco material and binding agent, and subjecting the tobacco-containing rod to conditions which cause the binding agent to become tacky.

12. A method as described in claim 10 or claim 11 in which the binding agent is an hygroscopic adhesive powder.

13. A method as described in claim 12 in which the binding agent is selected from the group consisting of an aqueous extract of tobacco, a magnesium acid phosphate, a reaction product of $Ca(OH)_2$ with a reducing sugar containing between about 5% and about 12% of calcium, pectin, sucrose, glucose and fructose.

14. A method as described in claim 12 wherein said hygroscopic adhesive powder has a particle size of between about 50 and about 200 microns.

15. A method as described in claim 14 wherein said hygroscopic adhesive powder becomes tacky upon absorption of moisture.

16. A method as described in claim 12 in which the tobacco materials include expanded tobacco.

17. A method as described in claim 16 in which the binding agent is selected from the group consisting of an aqueous extract of tobacco, a magnesium acid phosphate, a reaction product of $Ca(OH)_2$ with a reducing sugar containing between about 5% and about 12% of calcium, pectin, sucrose, glucose and fructose.

18. A method as described in claim 16 wherein said tobacco materials comprise a blend of shredded tobacco having between about 12% to about b 16% OV and comprising about 10% to about 40% expanded tobacco.

* * * * *